US010147579B2

(12) United States Patent
Diomedi et al.

(10) Patent No.: US 10,147,579 B2
(45) Date of Patent: Dec. 4, 2018

(54) ELECTRICAL DISTRIBUTION APPARATUS INCLUDING BARRIER AND METHODS OF ASSEMBLING SAME

(71) Applicant: ABB Schweiz AG, Baden, OT (CH)

(72) Inventors: Tyler Braden Diomedi, Plainville, CT (US); Suresh M, Telangana (IN); Justin Dubrosky, Bristol, CT (US); Fernando Jorge De Sousa Braga, Maia (PT); Leonardo Dorea Mascarenhas, Agawam, MA (US); Yogesh Ingole, Telangana (IN); Mariusz Duda, Berlin, CT (US); Tapas Ranjan Rout, Telangana (IN); Jorge Juan Bonilla Hernandez, Madrid (ES)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/402,428

(22) Filed: Jan. 10, 2017

(65) Prior Publication Data

US 2018/0138607 A1 May 17, 2018

(30) Foreign Application Priority Data

Nov. 11, 2016 (IN) ..... 201641038605

(51) Int. Cl.
*H01H 71/08* (2006.01)
*H01R 13/52* (2006.01)

(52) U.S. Cl.
CPC ..... *H01H 71/08* (2013.01); *H01R 13/5205* (2013.01); *H01R 13/5213* (2013.01)

(58) Field of Classification Search
CPC ..... H01R 4/46; H01R 4/363; H01R 4/22
USPC ..... 439/709
See application file for complete search history.

(56) References Cited

U.S. PATENT DOCUMENTS 4,513,169 A * 4/1985 McGrane ..... H02G 15/12 174/138 F
5,327,321 A 7/1994 Rosen
5,351,165 A 9/1994 Hancock
5,486,666 A * 1/1996 Wong ..... H01H 9/0264 200/304
5,533,912 A * 7/1996 Fillinger ..... H01R 13/5205 439/521
5,573,423 A * 11/1996 Lin ..... H01R 4/5025 439/462
5,727,317 A * 3/1998 Bekku ..... F16C 19/184 148/571
5,933,319 A 8/1999 Buckner et al.
(Continued)

FOREIGN PATENT DOCUMENTS

WO 2014209350 A1 12/2014
WO 2015029528 A1 3/2015

*Primary Examiner* — Harshad C Patel
(74) *Attorney, Agent, or Firm* — Barnes & Thornburg LLP

(57) ABSTRACT

An electrical device includes a power connector coupleable to a cable. The power connector defines an interior space and a cable opening, the power connector arranged to receive the cable into the interior space through the cable opening. The electrical device further includes a barrier arranged to at least partially cover the cable opening, said barrier comprising an inner collar and an outer collar, each of said inner collar and said outer collar arranged to receive at least a portion of the cable therethrough, wherein said outer collar circumscribes said inner collar.

17 Claims, 8 Drawing Sheets

(56) References Cited

U.S. PATENT DOCUMENTS

| | | | | |
|---|---|---|---|---|
| 6,162,098 | A * | 12/2000 | Cheng | H01R 13/68 439/620.29 |
| 6,364,720 | B1 * | 4/2002 | Liang | H01R 11/281 439/462 |
| 6,497,592 | B1 | 12/2002 | Beadle | |
| 6,936,781 | B2 * | 8/2005 | Quintanilla | H01H 9/0264 200/293 |
| 7,052,333 | B2 * | 5/2006 | Siracki | H01R 4/36 439/718 |
| 7,354,284 | B2 * | 4/2008 | Aime | H01R 13/443 439/148 |
| 7,572,155 | B2 * | 8/2009 | Elliott, III | H01R 4/36 439/709 |
| 8,727,818 | B2 * | 5/2014 | Kossak | H01R 4/34 439/718 |
| 2005/0109597 | A1 | 5/2005 | Etscheidt et al. | |
| 2006/0286862 | A1 | 12/2006 | Lubinsky et al. | |

* cited by examiner

ELECTRICAL DISTRIBUTION APPARATUS INCLUDING BARRIER AND METHODS OF ASSEMBLING SAME

CROSS REFERENCE TO RELATED APPLICATIONS

This application claims priority to Indian Patent Application No. 201641038605, filed Nov. 11, 2016, which is hereby incorporated by reference in its entirety.

BACKGROUND

The field of the disclosure relates generally to electrical distribution apparatuses, and more particularly, to an electrical distribution apparatus including at least one power connector and a barrier at least partially restricting access to the at least one power connector.

At least some known electrical distribution apparatuses are configured to control electrical distribution from a main to one or more branch circuits. Accordingly, at least some known electrical distribution apparatuses include power connectors such as terminals or lugs for coupling to the circuits. For example, in some electrical distribution apparatuses, a load terminal is positioned on an end of the electrical distribution apparatus and a line terminal is positioned on an opposite end of the electrical distribution apparatuses. In addition, electrical devices, such as circuit breakers, are coupled to the electrical distribution apparatus along an electrically conductive path between the load terminal and the line terminal. The electrical devices also include power connectors. Current flows through the electrical distribution apparatus from the line terminal to the load terminal. When the electrical distribution apparatus has a reverse feed, the current flows through the electrical distribution apparatus from the load terminal to the line terminal.

In at least some known electrical distribution apparatus, it is desirable to restrict access to electrically charged components of the electrical distribution apparatus, such as the power connectors. For example, at least some regulations require that the accessibility of electrically charged components of electrical distribution apparatuses is limited during operation of the electrical distribution apparatuses. As a result, the cost to manufacture and assemble the electrical distribution apparatuses is increased.

BRIEF DESCRIPTION

In one aspect, an electrical device is provided. The electrical device includes a power connector coupleable to a cable, the power connector defining an interior space and a cable opening, the power connector arranged to receive the cable into the interior space through the cable opening, and a barrier arranged to at least partially cover the cable opening, said barrier comprising an inner collar and an outer collar, each of said inner collar and said outer collar arranged to receive at least a portion of the cable therethrough, wherein said outer collar circumscribes said inner collar.

In another aspect, a barrier for an electrical device is provided. The electrical device includes a power connector. The power connector defines a cable opening to receive the cable therein. The power connector is coupleable to a cable. The barrier includes a wall, an inner collar, and an outer collar. The wall is coupleable to the power connector and is arranged to cover at least a portion of the cable opening. The inner collar is arranged to receive at least a portion of the cable and is at least partly formed by the wall. The outer is collar arranged to receive at least a portion of the cable and circumscribes the inner collar.

In yet another aspect, a method of assembling an electrical device is provided. The method includes coupling a power connector to a case such that the power connector is disposed at least partially within an interior space defined by the case. The power connector is coupleable to a cable and defines a cable opening to receive the cable therein. The method also includes coupling a barrier to the power connector. The barrier is arranged to at least partially cover the cable opening. The barrier includes an inner collar and an outer collar. Each of the inner collar and the outer collar is arranged to receive at least a portion of the cable. The outer collar circumscribes the inner collar.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of electrical devices and methods of manufacturing devices are described herein. The electrical devices include barriers that restrict access to (i.e., inhibit an operator contacting) electrically conductive components of the electrical devices. For example, in some embodiments, the barriers are directly coupled to power connectors of the electrical devices. The barriers include collars to restrict access to the power connectors. In addition, the barriers are coupled to the power connectors without the use of tools. For example, in some embodiments, the barriers include engagement features for removably coupling to the power connectors. Also, in some embodiments, the barriers include inserts. For example, in some embodiments, reducers are positioned in openings of the barriers to facilitate the electrical devices coupling to cables having different sizes.

Figure 1:
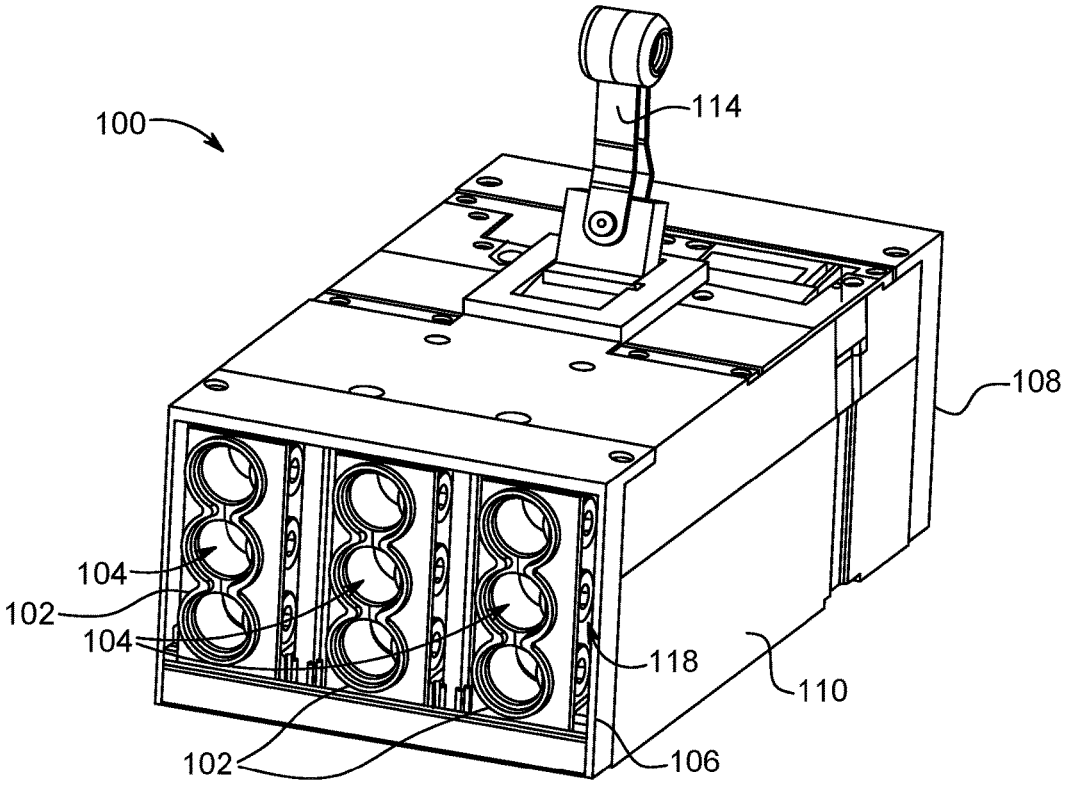
FIG. 1 is a perspective view of an electrical device including barriers.
Figure 2:
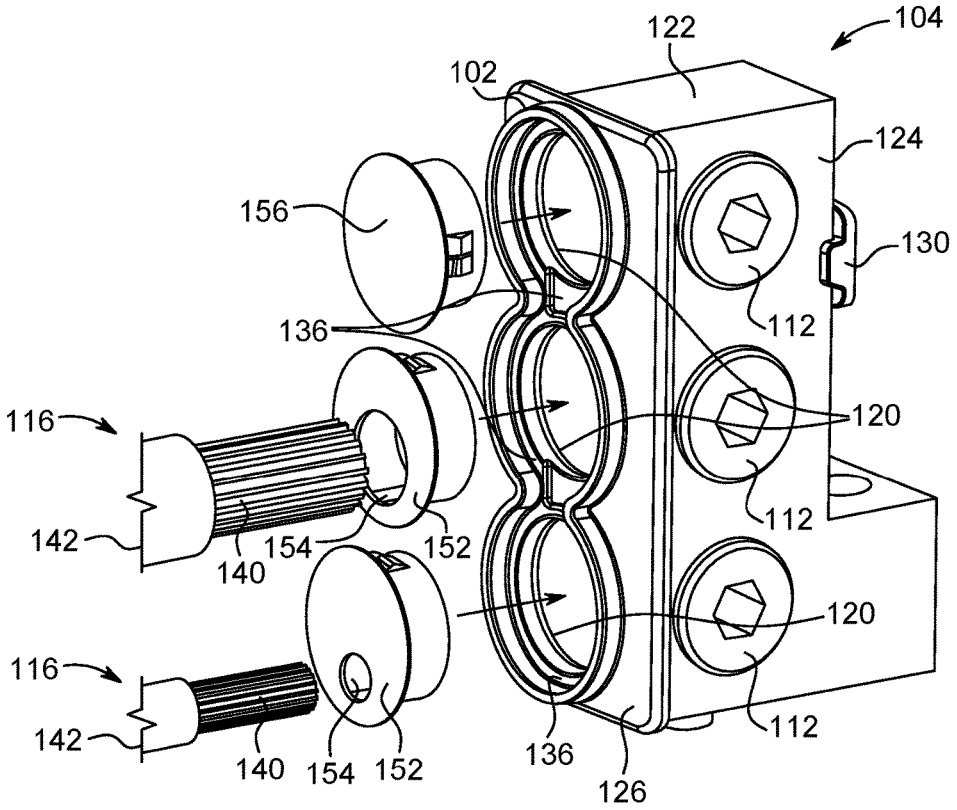
FIG. 2 is a schematic perspective view of a power connector of the electrical device shown in FIG. 1.

FIG. 1 is a perspective view of an electrical device or circuit breaker 100 including barriers 102. FIG. 2 is a schematic perspective view of a power connector 104 of circuit breaker 100. In alternative embodiments, power connector 104 is used with any electrical device and not necessarily used with a circuit breaker. For example, in some embodiments, power connector 104 is coupled directly to a panel (not shown) and is not coupled to a circuit breaker.

In the exemplary embodiment, circuit breaker 100 includes shields or barriers 102, a first end 106, a second end 108, a case 110, at least one power connector or lug 104, at least one coupler 112, and an operating mechanism 114. First end 106 is opposite second end 108. First end 106 and second end 108 are configured to couple to a circuit. For example, power connectors 104 are positioned adjacent first end 106 and/or second end 108 and are configured to couple to cables 116. In alternative embodiments, circuit breaker 100 includes any component that enables circuit breaker 100 to operate as described herein. For example, in some embodiments, circuit breaker 100 includes load straps, movable contacts, and/or trip mechanisms. In the exemplary embodiment, circuit breaker 100 is coupled to a circuit such that circuit breaker 100 controls flow of electric current through the circuit. In particular, when operating mechanism 114 of circuit breaker 100 is triggered, i.e., circuit breaker 100 is tripped, the flow of electric current through the circuit coupled to circuit breaker 100 is stopped.

In the exemplary embodiment, each power connector 104 is coupled to case 110 and is disposed within an interior space 118 of case 110. Each power connector 104 is coupleable to cable 116 and includes at least one opening 120 arranged to receive cable 116. Openings 120 are defined in an outer surface 122 of a body 124 of power connector 104. Coupler 112 is configured to secure cable 116 to power connector 104. For example, in the exemplary embodiment, coupler 112 includes a fastener that is selectively positionable to secure a portion of cable 116 to power connector 104. In alternative embodiments, circuit breaker 100 includes any power connector 104 that enables circuit breaker 100 to operate as described herein.

In addition, in the exemplary embodiment, barrier 102 is directly coupled to power connector 104 and restricts access to (i.e., inhibit an operator contacting) power connector 104. In particular, barrier 102 inhibits objects, such as a finger, directly contacting power connector 104 when power connector 104 is coupled to cable 116. In addition, barrier 102 provides access to couplers 112 to facilitate coupling cable 116 to power connector 104. Accordingly, in some embodiments, barrier 102 is coupled to power connector 104 prior to coupling cables 116 to power connector 104. In further embodiments, barrier 102 remains coupled to power connector 104 when cables 116 are coupled to power connector 104. In alternative embodiments, barrier 102 is coupled to any portion of circuit breaker 100. For example, in some embodiments, barrier 102 is coupled to case 110.

In the exemplary embodiment, cables 116 include electrically conductive materials surrounded by non-electrically conductive materials. At least a portion of the electrically conductive materials are exposed to couple to circuit breaker 100. The cables 116 are elongated and flexible to couple to circuit breaker 100. In alternative embodiments, circuit breaker 100 couples to any cable 116 that enables circuit breaker 100 to operate as described herein.

Figure 4:
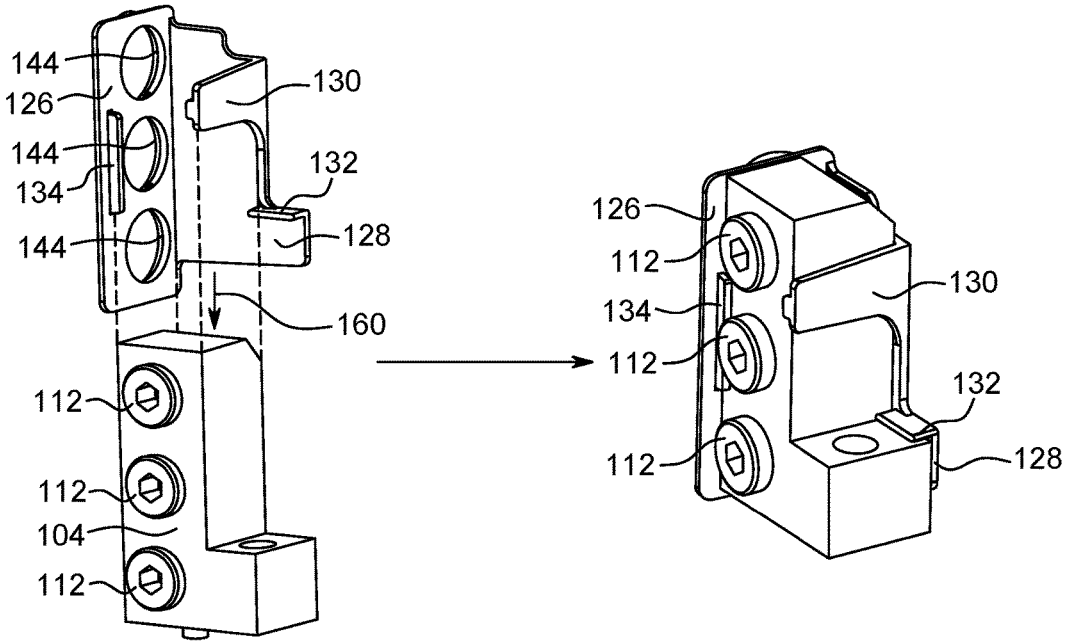
FIG. 4 is a schematic of coupling a barrier to the power connector shown in FIG. 2.

In reference to FIGS. 2 and 4, barrier 102 includes a wall 126, a sidewall 128, an arm 130, a stop 132, a guide 134, inner collars 136, and outer collars 138. In the exemplary embodiment, wall 126 is substantially planar and contacts surface 122 of power connector 104 when barrier 102 is coupled to power connector 104. Sidewall 128 extends from wall 126 such that sidewall 128 and wall 126 are substantially perpendicular. Accordingly, barrier 102 conforms to the shape of power connector 104 and does not increase the footprint of circuit breaker 100 (shown in FIG. 1). In addition, barrier 102 does not extend into gutter space of circuit breaker 100 (shown in FIG. 1). In the exemplary embodiment, barrier 102 is a single piece. In alternative embodiments, power connector 104 includes any barrier 102 that enables power connector 104 to operate as described herein. For example, in some embodiments, barrier 102 includes a plurality of walls 126 and/or sidewalls 128. In further embodiments, barrier 102 surrounds power connector 104.

In the exemplary embodiment, each inner collar 136 is configured to receive an uninsulated portion 140 of cable 116. Each outer collar 138 is configured to receive an insulated portion 142 of cable 116. In the exemplary embodiment, barrier 102 includes three inner collars 136 and three outer collars 138. Inner collars 136 are formed by wall 126. Each outer collar 138 is substantially ring-shaped and extends from wall 126 opposite power connector 104 when barrier 102 is coupled to power connector 104. Outer collar 138 circumscribes inner collar 136. In alternative embodiments, barrier 102 includes any collar that enables barrier 102 to operate as described herein.

Figure 3:
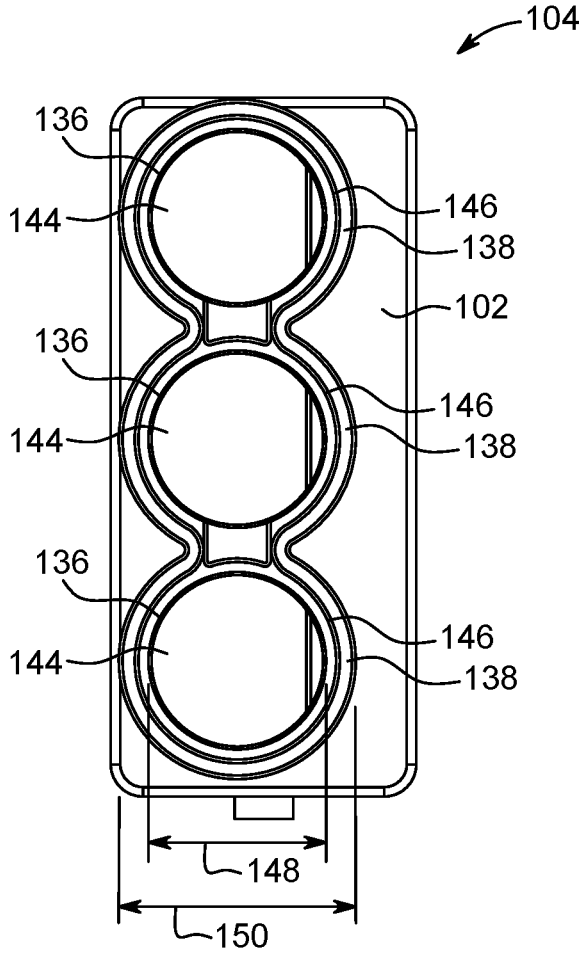
FIG. 3 is a front view of the power connector shown in FIG. 2.

FIG. 3 is a front view of power connector 104. In the exemplary embodiment, each inner collar 136 defines an inner opening 144. Each outer collar 138 defines an outer opening 146. Inner opening 144 is circular and has a first diameter 148. Outer opening 146 is circular and has a second diameter 150 that is larger than a respective first diameter 148. Accordingly, outer opening 146 is larger than a respective inner opening 144. In alternative embodiments, barrier 102 includes any opening that enables barrier 102 to function as described herein.

Also, in the exemplary embodiment, barrier 102 is arranged such that inner openings 144 and outer openings 146 substantially align with openings 120 of power connector 104 when barrier 102 is coupled to power connector 104. Accordingly, cable 116 extends through inner opening 144 and outer opening 146 and into opening 120 for coupling to power connector 104. Inner opening 144 and outer opening 146 are sized to receive a range of cables 116. Accordingly, barrier 102 receives different cables 116 without the use of one-time use adjustors such as knockouts. Moreover, in some embodiments, circuit breaker 100 (shown in FIG. 1) is coupled to different cables without the removal of barrier 102.

FIG. 4 is a schematic of coupling barrier 102 to power connector 104. Barrier 102 includes arm 130 that extends around power connector 104 when barrier 102 is coupled to power connector 104. Arm 130 acts as an engagement feature and facilitates barrier 102 coupling to power connector 104 without the use of tools. In addition, barrier 102 includes stop 132 and guide 134 to facilitate positioning barrier 102 relative to power connector 104. Guide 134 is an elongated projection extending longitudinally along wall 126. Guide 134 facilitates barrier 102 sliding along power connector 104 in an installation direction 160. Stop 132 extends from sidewall 128 and is arranged to abut against a portion of power connector 104 when barrier 102 is coupled to power connector 104. In alternative embodiments, circuit breaker 100 (shown in FIG. 1) includes any engagement feature that enables circuit breaker 100 (shown in FIG. 1) to operate as described herein. For example, in some embodiments, barrier 102 and/or power connector 104 includes, without limitation, latches, clips, adhesive, straps, engaging walls, snaps, and any other engagement feature.

In the exemplary embodiment, during operation, barrier 102 is coupled to power connector 104 by positioning barrier 102 relative to power connector 104 and sliding barrier 102 along power connector 104. Guide 134 slides along power connector 104 to guide barrier 102 into position. Stop 132 contacts power connector 104 and inhibits further movement of barrier 102 when inner openings 144 are aligned with openings 120 (shown in FIG. 2) of power connector 104. Arm 130, guide 134, and stop 132 inhibit displacement of barrier 102 when barrier is positioned on power connector 104. In alternative embodiments, barrier 102 is coupled to power connector 104 in any manner that enables power connector 104 to operate as described herein.

In reference to FIG. 2, in the exemplary embodiment, reducers 152, broadly inserts, are coupled to barrier 102 within inner openings 144. Reducers 152 facilitate barrier 102 receiving cables 116 having different sizes. In the exemplary embodiment, reducers 152 are annular in shape and include openings 154 that are smaller than inner opening 144. During operation, reducers 152 are coupled to barrier 102 by inserting reducers 152 into inner opening 144 until a snap fit is achieved. Accordingly, reducers 152 are coupled to barrier 102 without the use of tools. In alternative embodiments, barrier 102 includes any reducer that enables barrier 102 to function as described herein.

In addition, in the exemplary embodiment, a plug 156, broadly an insert, is coupled to barrier 102 within inner opening 144 defined by inner collar 136. Plug 156 covers inner opening 144 and inhibits objects contacting power connector 104. Plug 156 is removably coupled to barrier 102. During operation, plug 156 is coupled to barrier 102 by inserting plug 156 into inner opening 144 until a snap fit is achieved. Accordingly, plug 156 is coupled to barrier 102 without the use of tools. In alternative embodiments, barrier 102 includes any insert that enables barrier 102 to function as described herein.

Figure 5:
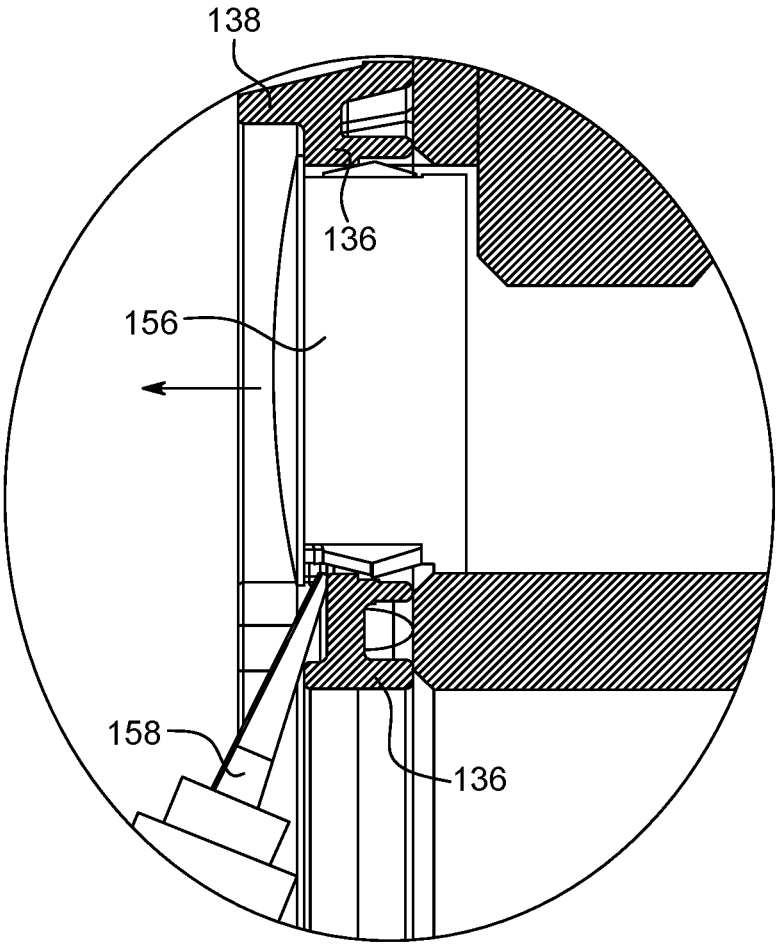
FIG. 5 is a cross-sectional schematic of removing an insert from the barrier shown in FIG. 4.

FIG. 5 is a cross-sectional schematic of removing an insert from barrier 102. In some embodiments, a tool 158 is used to remove reducers 152 (shown in FIG. 2) and plug 156 from barrier. For example, as shown in FIG. 4, in some embodiments, tool 158 is inserted at least partially between an edge of plug 156 and barrier 102. A force is applied to tool 158 to remove plug 156 from barrier 102. In alternative embodiments, inserts are removed from barrier 102 in any manner that enables barrier 102 to function as described herein. For example, in some embodiments, barrier 102 includes a removal feature to facilitate removal of the inserts.

Figure 6:
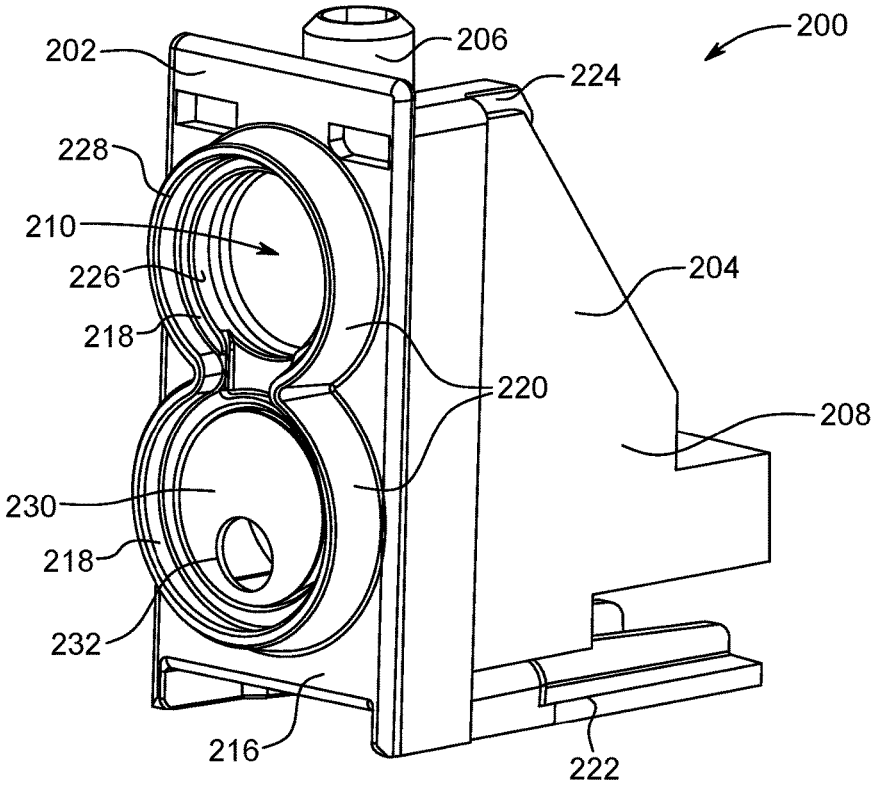
FIG. 6 is a perspective view of an alternative embodiment of a power connector for use with the electrical device shown in FIG. 1 including a barrier.
Figure 7:
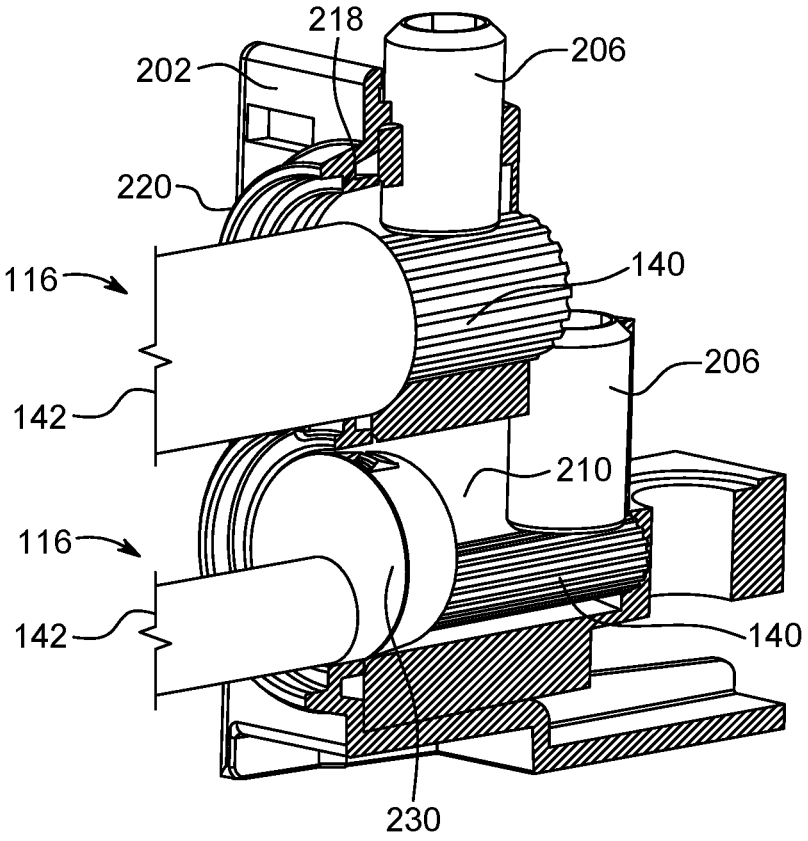
FIG. 7 is a partial cross-sectional perspective view of the power connector shown in FIG. 6.
Figure 8:
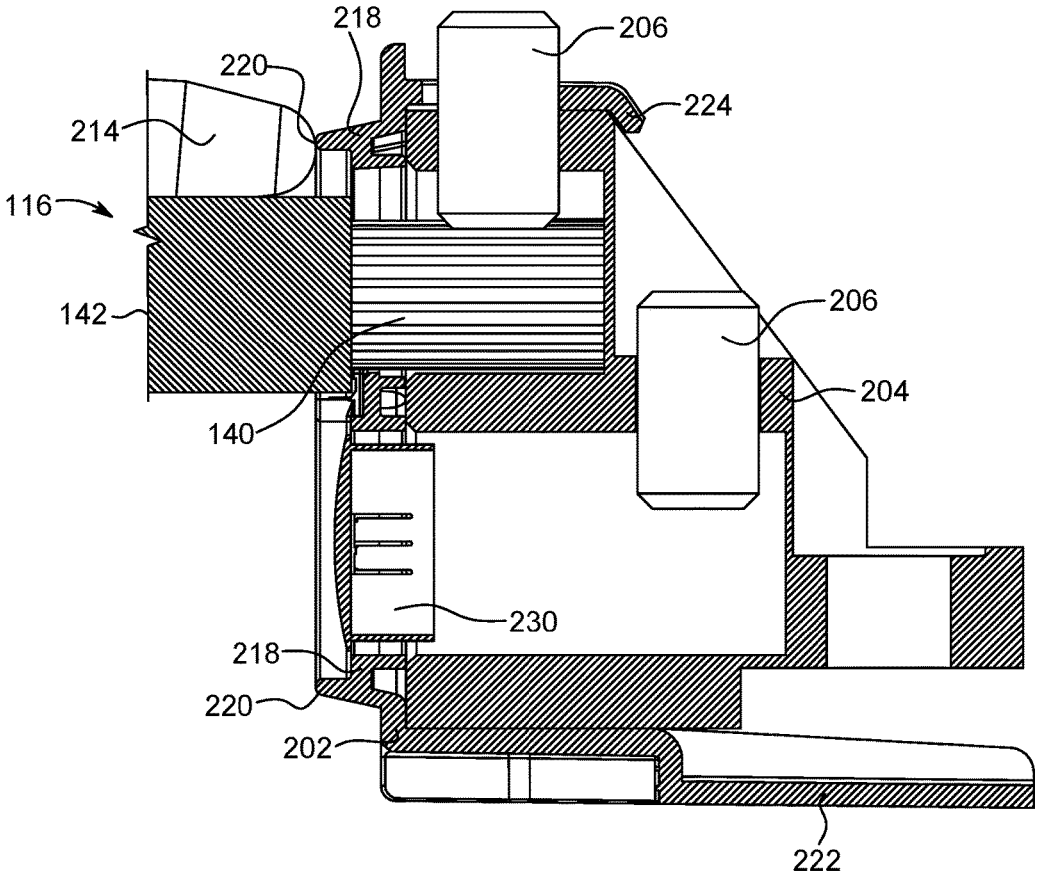
FIG. 8 is a cross-sectional schematic of the power connector shown in FIG. 6.

FIG. 6 is a perspective view of a power connector 200 for use with circuit breaker 100 (shown in FIG. 1) including a barrier 202. FIG. 7 is a partial cross-sectional perspective view of power connector 200. FIG. 8 is a cross-sectional schematic of power connector 200. Power connector 200 includes a body 204 and couplers 206. Body 204 defines an outer surface 208 and an interior space 210. Couplers 206 are arranged to secure cables 116 within interior space 210. In alternative embodiments, power connector 200 includes any component that enables power connector 200 to operate as described herein.

In the exemplary embodiment, barrier 202 is removably coupled to power connector 200 to restrict access to power connector 200. Barrier 202 includes a wall 216, inner collars 218, outer collars 220, a base 222, and an engagement feature 224. Each inner collar 218 is configured to receive uninsulated portion 140 of cable 116. Each outer collar 220 is configured to receive insulated portion 142 of cable 116. In the exemplary embodiment, barrier 202 includes two inner collars 218 and two outer collars 220. Inner collars 218 are formed by wall 216 and define inner openings 226. Each outer collar 220 is ring-shaped and extends from wall 216 opposite power connector 200 when barrier 202 is coupled to power connector 200. Each outer collar 220 circumscribes a respective inner collar 218 and defines an outer opening 228. In alternative embodiments, barrier 202 includes any collar that enables barrier 202 to operate as described herein. For example, in some embodiments, outer collar 220 extends adjacent only a portion of inner collar 218 and does not circumscribe inner opening 226. In further embodiments, outer collar 220 is discontinuous.

Also, in the exemplary embodiment, barrier 202 facilitates power connector 200 coupling to different cables 116. In particular, inner openings 226 and outer openings 228 are sized to receive a range of cables 116. Accordingly, barrier 202 receives different cables 116 without the use of one-time use adjustors such as knockouts. Moreover, in some embodiments, circuit breaker 100 (shown in FIG. 1) is coupled to different cables without the removal of barrier 202.

In addition, in the exemplary embodiment, a reducer 230 is positioned in inner opening 226 and restricts access to power connector 200 when power connector 200 is coupled to smaller cables 116. In particular, reducer 230 includes an opening 232 that is smaller than inner opening 226 and receives uninsulated portion 142 of cable 116. Reducer 230 inhibits an object 214 passing between cable 116 and inner collar 218. In alternative embodiments, barrier 202 includes any insert that enables barrier 202 to function as described herein.

In reference to FIG. 8, barrier 202 inhibits object 214, such as a finger, directly contacting power connector 200 when power connector 200 is coupled to cable 116. In particular, outer collar 220 surrounds an insulated portion 140 of cable 116 and forms an annular space that prevents object 214 passing between outer collar 220 and cable 116. In addition, inner collar 218 surrounds an uninsulated portion 142 of cable 116 and forms an annular space that prevents object 214 passing between inner collar 218 and cable 116.

In addition, in the exemplary embodiment, engagement feature 224 is flexible to facilitate barrier 202 removably coupling to power connector 200. During operation, barrier 202 is coupled to power connector 200 by positioning barrier 202 relative to power connector 200 and moving barrier 202 towards power connector 200. Base 222 moves along a bottom of body 204 and guides barrier 202 into position. As barrier 202 is moved towards power connector 200, power connector 200 contacts and displaces engagement feature 224. Barrier 202 is moved toward power connector 200 until wall 216 abuts against a front portion of outer surface 208, in reference to the orientation shown in FIG. 8. Engagement feature 224 is arranged such that engagement feature 224 moves to a neutral position when wall 216 contacts outer surface 208. In the neutral position, engagement feature 224 engages body 204 and inhibits removal of barrier 202. In alternative embodiments, barrier 202 is coupled to power connector 200 in any manner that enables power connector 200 to operate as described herein.

In reference to FIGS. 1-3, a method of assembling circuit breaker 102 includes coupling power connector 104 to case 110 such that power connector 104 is disposed at least partially with interior space 118 defined by case 110. The method also includes coupling barrier 102 to power connector 104. In some embodiments, cable 116 is coupled to power connector 104 and barrier 102 is positioned such that at least a portion of cable 116 extends through inner opening 144 and outer opening 146. In further embodiments, the method includes aligning inner collar 136 and outer collar 138 with opening 120. In some embodiments, engagement feature 224 is displaced when barrier 102 is coupled to power connector 104. In further embodiments, the method includes coupling reducer 152 and/or plug 156 to barrier 102.

The electrical distribution apparatus described above generally include barriers that restrict access to electrically conductive components of the electrical devices. For example, in some embodiments, the barriers are directly coupled to power connectors of the electrical devices. The barriers include collars to restrict access to the power connectors. In addition, the barriers are coupled to the power connectors without the use of tools. For example, in some embodiments, the barriers include engagement features for removably coupling to the power connectors. Also, in some embodiments, the barriers include inserts. For example, in some embodiments, reducers are positioned in openings of the barriers to facilitate the electrical devices coupling to cables having different sizes.

An exemplary technical effect of the methods, systems, and apparatus described herein includes at least one of: (a) reducing cost to assemble electrical devices; (b) providing barriers that restrict access to power connectors of electrical devices; (c) providing barriers for electrical devices that are installed without the use of tools; (d) providing electrical devices that are adjustable to accommodate cables of different sizes; and (e) reducing the size of electrical devices.

Exemplary embodiments of electrical distribution apparatus and methods of manufacturing electrical distribution apparatus are described above in detail. The electrical distribution apparatus and methods are not limited to the specific embodiments described herein but, rather, components of the electrical distribution apparatus and/or operations of the methods may be utilized independently and separately from other components and/or operations described herein. Further, the described components and/or operations may also be defined in, or used in combination with, other systems, methods, and/or devices, and are not limited to practice with only the electrical distribution apparatus and systems described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrical device, coupleable to a cable, the electrical device comprising:

a power connector coupleable to the cable, said power connector defining an interior space and a cable opening, said power connector arranged to receive the cable into the interior space through the cable opening;

a barrier removeably coupled to the power connector and arranged to at least partially cover the cable opening, said barrier comprising (i) an inner collar having a first opening and (ii) an outer collar having a second opening larger than said first opening, each of said inner collar and said outer collar arranged to receive at least a portion of the cable therethrough, wherein said outer collar circumscribes said inner collar; and a reducer removably coupled to said barrier, said reducer positioned within said first opening, the reducer defining a third opening therethrough, the third opening being smaller the the first opening.

2. The electrical device in accordance with claim 1, wherein said barrier further comprises a wall disposed opposite the power connector, the wall at least partly forming said inner collar, and wherein said outer collar extends from said wall.

3. The electrical device in accordance with claim 2, wherein said first opening is sized to receive only an un-insulated portion of the cable therethrough, and wherein said second opening is sized to receive an insulated portion of the cable therethrough.

4. The electrical device in accordance with claim 1, wherein said first opening is circular and has a first diameter, and wherein said second opening is circular and has a second diameter larger than the first diameter.

5. The electrical device in accordance with claim 1 further comprising a plug removably coupled to said barrier, said plug positioned within said first opening to close said first opening.

6. The electrical device in accordance with claim 1, wherein said barrier is a single piece.

7. The electrical device in accordance with claim 1, wherein said barrier inhibits an operator contacting said power connector through said first opening when said power connector is coupled to the cable.

8. The electrical device in accordance with claim 1, wherein said barrier further comprises a plurality of inner collars and a plurality of outer collars such that said barrier is arranged to receive a plurality of cables coupled to said power connector.

9. The electrical device in accordance with claim 1, wherein said barrier is removably coupled to at least one of a line end and a load end of the power connector.

10. The electrical device in accordance with claim 1, wherein the barrier surrounds the power connector.

11. The electrical device in accordance with claim 1, wherein the barrier conforms to the peripheral shape of the power connector.

12. The electrical device in accordance with claim 1, wherein the barrier does not increases the footprint of the electrical device.

13. A barrier for an electrical device, the electrical device including a power connector coupleable to a cable, the power connector defining a cable opening to receive the cable therein, said barrier comprising:

an engagement feature to removeably couple the barrier to the power connector;

a wall disposed opposite the power connector, and arranged to cover at least a portion of the cable opening;

an inner collar defining a first opening arranged to receive at least a portion of the cable, said inner collar at least partly formed by said wall;

an outer collar defining a second opening larger than said first opening, arranged to receive at least a portion of the cable, wherein said outer collar circumscribes said inner collar; and an insert removably coupled to said barrier, said insert positioned within said first opening, the insert defining a third opening therethrough, the third opening being smaller than the first opening.

14. The barrier in accordance with claim 13 wherein said wall is arranged such that said inner collar is aligned with the cable opening of the power connector.

15. The barrier in accordance with claim 14, wherein said outer collar comprises a ring extending from said wall.

16. The barrier in accordance with claim 13, wherein said first opening is circular and has a first diameter, and wherein said second opening is circular and has a second diameter larger than the first diameter.

17. The barrier in accordance with claim 13, wherein the engagement feature comprises at least one of (i) a stop to abut against a portion of the power connector when the barrier is coupled to the power connector and (ii) a guide feature to facilitate positioning of the barrier relative to the power connector in an installation direction.

* * * * *